US009623947B1

(12) United States Patent
Wilson

(10) Patent No.: US 9,623,947 B1
(45) Date of Patent: Apr. 18, 2017

(54) FLEXIBLE LINKAGE DRIVEN OUTBOARD DRIVE UNIT WITH 360 DEGREE ROTATION OF LOWER UNIT

(71) Applicant: Bradley Rey Wilson, Marrero, LA (US)

(72) Inventor: Bradley Rey Wilson, Marrero, LA (US)

(73) Assignee: Bradley Rey Wilson, Marrero, LA (US)

( * ) Notice: Subject to any disclaimer, the term of this patent is extended or adjusted under 35 U.S.C. 154(b) by 0 days.

(21) Appl. No.: 14/844,204

(22) Filed: Sep. 3, 2015

(51) Int. Cl.
*B63H 20/10* (2006.01)
*B63H 20/12* (2006.01)
*B63H 20/06* (2006.01)

(52) U.S. Cl.
CPC ..... *B63H 20/12* (2013.01); *B63H 20/06* (2013.01)

(58) Field of Classification Search
CPC ..... B63H 20/10
See application file for complete search history.

(56) References Cited

U.S. PATENT DOCUMENTS

| | | | | |
|---|---|---|---|---|
| 2,739,561 A * | 3/1956 | Kiekhaefer | ..... | B63H 20/10 440/55 |
| 4,676,756 A * | 6/1987 | Rodrigue | ..... | B63H 20/10 114/355 |
| 4,869,692 A * | 9/1989 | Newman | ..... | B63H 21/28 440/75 |
| 5,088,945 A * | 2/1992 | Onoue | ..... | B63H 20/10 248/640 |
| 2011/0195620 A1* | 8/2011 | Davis | ..... | B63H 20/14 440/75 |

* cited by examiner

*Primary Examiner* — Stephen Avila

(57) ABSTRACT

This is a means to solve a problem with flexible linkage driven outboard motors or better known as shallow water belt drive surface driven outboard drive units. This design gives a horizontal drive shaft engine or motor that uses flexible linkage to drive a driven shaft with a propeller the option to drive or propel a boat or watercraft in all directions to include reverse, and not be limited to turning and steering less than 360 degrees. This design also does not restrict a flexible linkage to driven shaft outboard to a limited steering degree of an angle on the steering axis from where said motor rotates to steer. This design eliminates the need for an optional means to change the rotation direction of propeller to achieve reverse.

1 Claim, 17 Drawing Sheets

FLEXIBLE LINKAGE DRIVEN OUTBOARD DRIVE UNIT WITH 360 DEGREE ROTATION OF LOWER UNIT

CROSS-REFERENCE

Provisional application number 62046895

DESCRIPTION

Background of the Invention

The present invention is in the technical field of outboard motors. More particularly, the present invention is in the technical field of surface drive shallow water outboard drive units.

The problem with horizontal drive shaft motor with flexible linkage to driven shaft outboard drive units that are equipped with reverse is you have to make complex designs to achieve reverse.

These complex designs make horizontal drive shaft motor with flexible linkage to driven shaft outboard drive units that are equipped with reverse less reliable and add greater chance for failure or breakage due to the extra moving parts.

These complex designs make horizontal drive shaft motor with flexible linkage to driven shaft outboard drive unit that are equipped with reverse in most cases heavier due to their design because they require more moving parts and that in turn adds more weight.

These complex designs make horizontal drive shaft motor with flexible linkage to driven shaft outboard drive unit that are equipped with reverse in most cases more expensive to manufacture.

These complex designs make horizontal drive shaft motor with flexible linkage to driven shaft outboard drive unit that are equipped with reverse not efficient in power when in reverse due to the propeller design. Because propellers are designed to be most efficient when rotating in designed direction for optimum propulsion either clockwise or counter clockwise but not both.

Horizontal drive shaft motor with flexible linkage to driven shaft outboard drive units that are equipped or not equipped with reverse also can only be turned on a steering axis to a certain degrees due to the design and the way the flexible linkage and drive assembly is housed, and the way they are hinged for pivoting on steering axis on transom mounting bracket of watercraft which in turn limits the direction in which you can propel the boat or vessel. (Approximately 180 degrees or less)

SUMMARY OF THE INVENTION

The present invention seeks to provide a solution to these problems by providing a horizontal drive shaft motor with flexible linkage to driven shaft outboard drive unit that can turn up to 360 degrees and provide reverse direction to a watercraft and with the most efficiency of the propeller and without having to have complex reverse designs and or extra mechanical or moving parts to propel watercraft in all directions to include reverse.

BRIEF DESCRIPTION OF THE DRAWING

FIG. 8 illustrates a polar angle graph with horizontal drive shaft motor with flexible linkage to driven shaft outboard drive unit in center of said graph to explain steering axis and how horizontal drive shaft motor with flexible linkage to driven shaft outboard drive unit achieves 360 degrees of rotation all parts of said motor are pivotally rotational from center of said graph but not to include Transom mounting bracket, motor tilt brackets, female pivot section, and motor tilt pin that remain at polar angle 90 degrees, in this view the drive shaft and propeller are at polar angle 90 degrees.

DETAILED DESCRIPTION OF THE INVENTION

Figure 1:
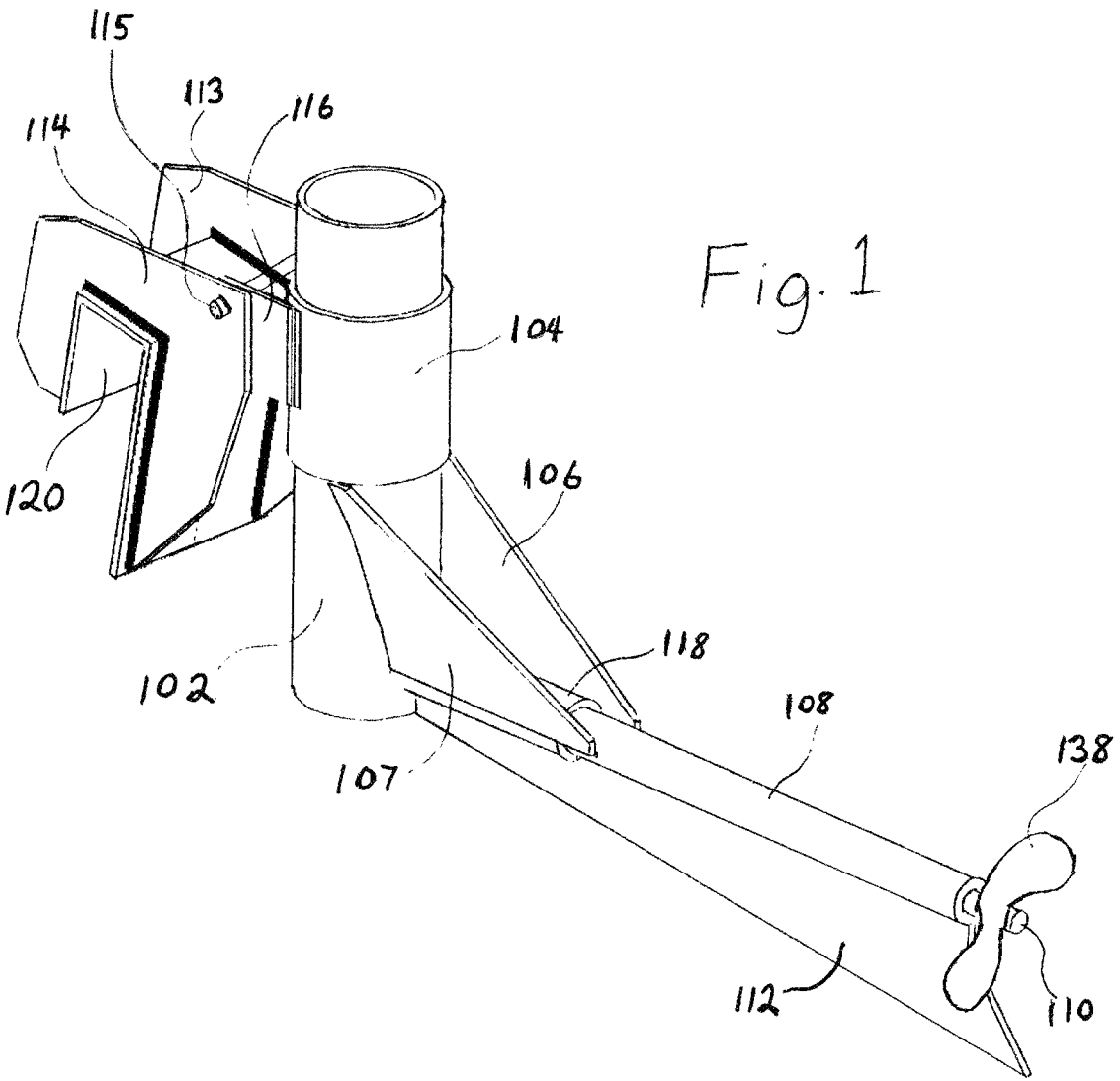
FIG. 1 is a perspective view of horizontal drive shaft motor with flexible linkage to driven shaft outboard drive unit, showing the lower unit and transom mounting bracket without showing horizontal drive shaft motor.
Figure 2:
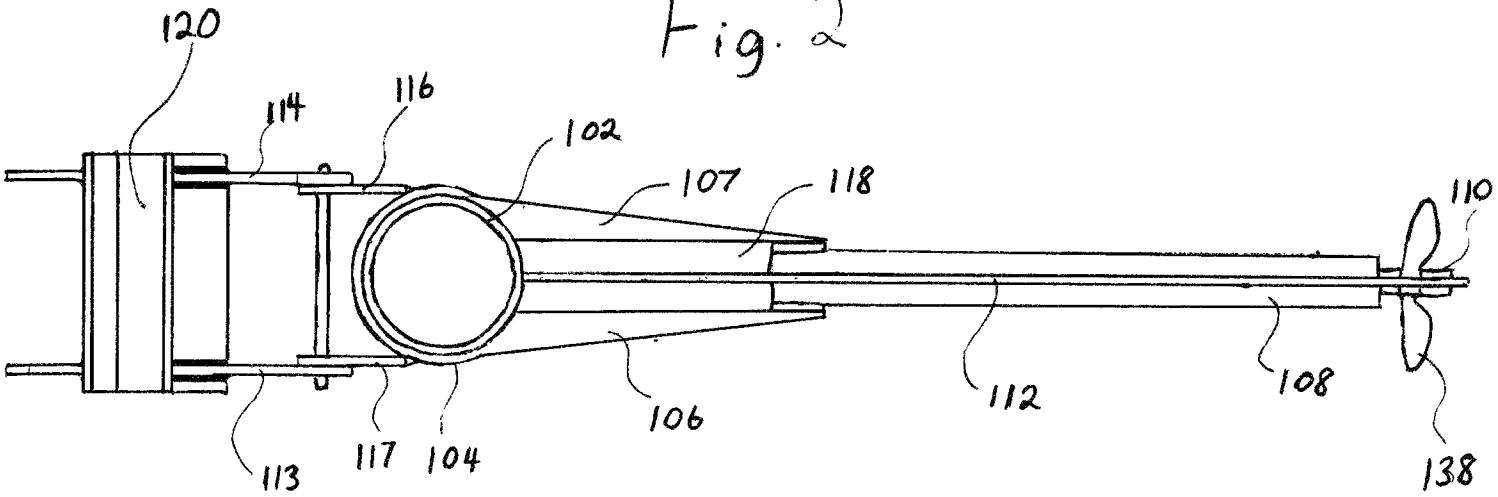
FIG. 2 is a bottom view looking perpendicular from the level ground up of horizontal drive shaft motor with flexible linkage to driven shaft outboard drive unit, without showing horizontal drive shaft motor.
Figure 3:
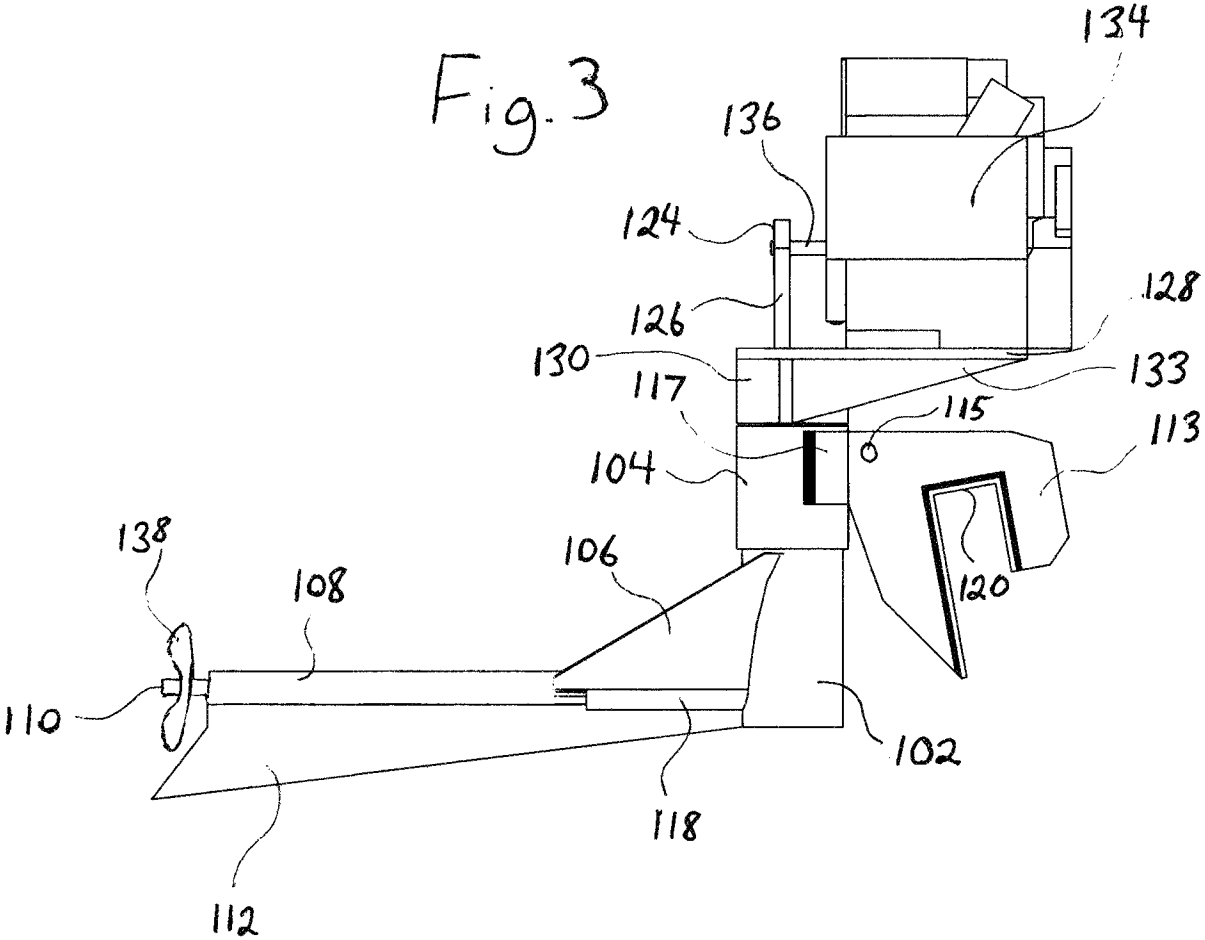
FIG. 3 is side 2 view of horizontal drive shaft motor with flexible linkage to driven shaft outboard drive unit.
Figure 4:
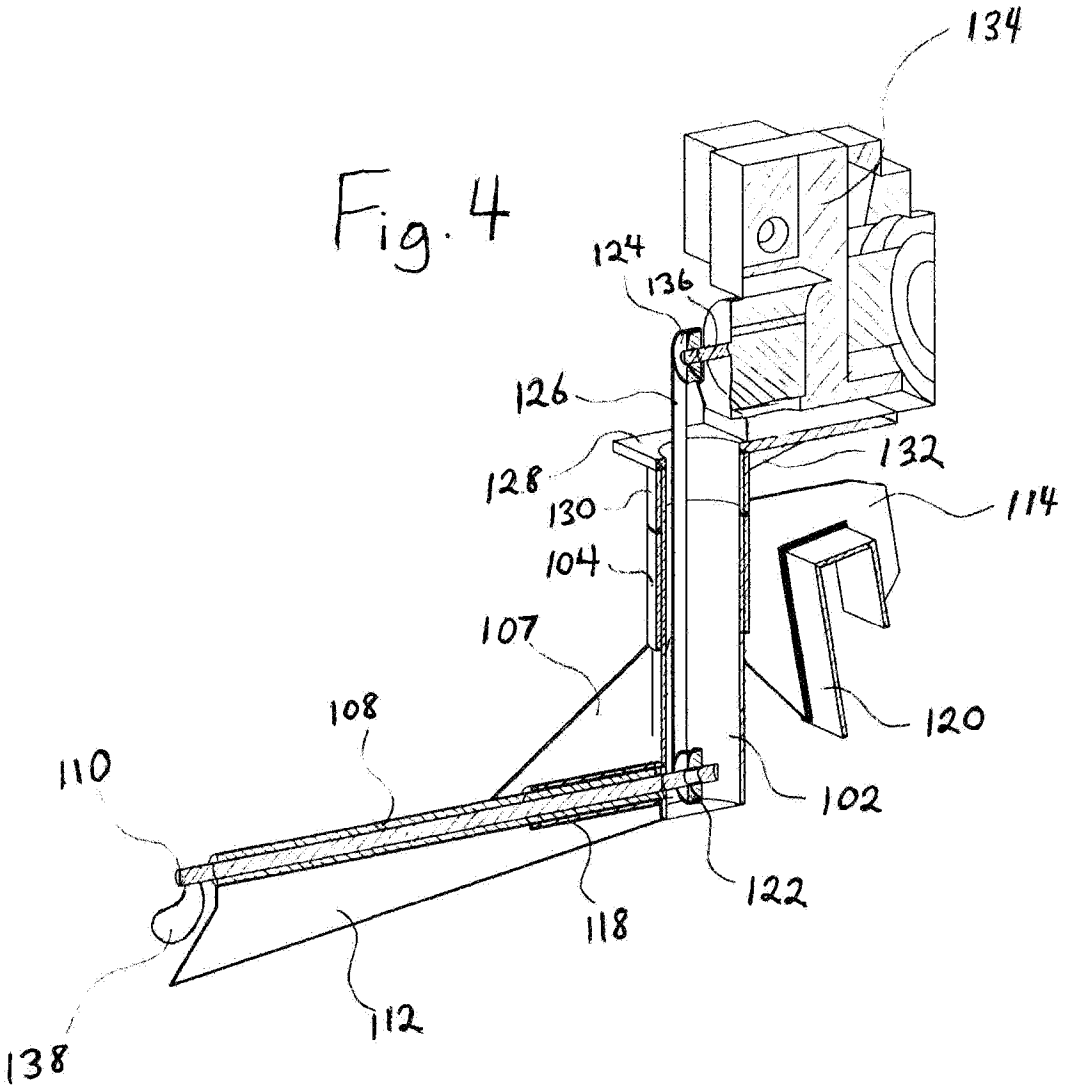
FIG. 4 is a perspective sectional view of horizontal drive shaft motor with flexible linkage to driven shaft outboard drive unit to show inside of lower unit.
Figure 5:
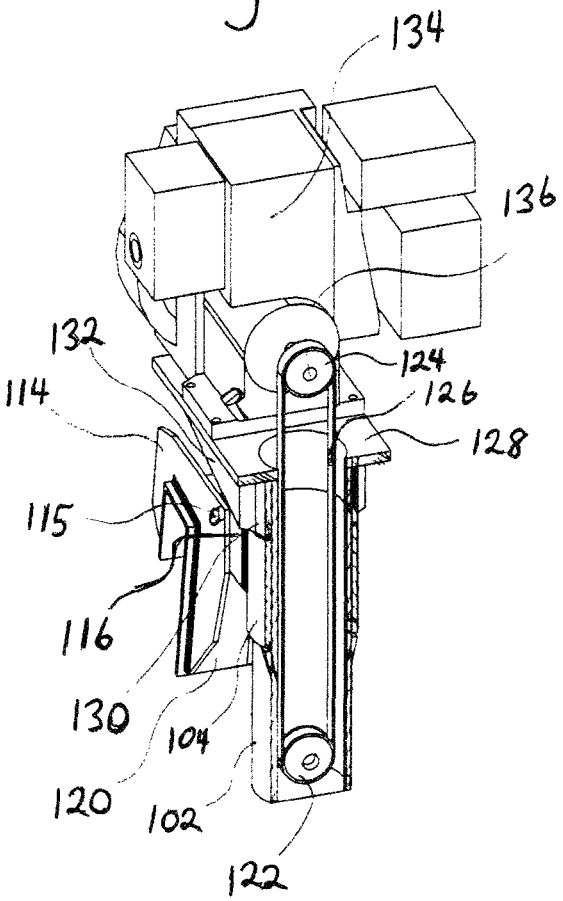

Referring now to the invention detail, from FIG. 1 through FIG. 17 there is shown a horizontal drive shaft motor with flexible linkage to driven shaft outboard drive unit comprising of a horizontal drive shaft engine 134 which has a drive sprocket, pulley, sheave, or other device 124 connected to drive shaft 136 of horizontal drive shaft engine 134 which drives the drive belt, chain, or other flexible linkage 126 which then in turn drives the driven sprocket, pulley, sheave, or other device 122 which is connected to the driven, drive shaft 110 which then turns the propeller 138 which propels the watercraft. The sprocket, pulley, sheave, or other device 124 and belt, chain, or other flexible linkage 126 and driven sprocket, pulley, sheave, or other device 122 go inside this main lower unit housing 102. The main lower unit housing 102 goes through female housing pivot section 104. Lower unit supports 106 and 107 support lower unit shaft housing 108 and lower unit bearing housing 118. The Skeg 112 is to help protect propeller 138 also attaches to lower unit shaft housing 108 and also to the lower unit bearing housing 118 and to the main lower unit housing 102 on bottom side. Transom mounting bracket 120 and transom mounting bracket supports 113 and 114 attaches to the horizontal drive shaft motor with flexible linkage to driven shaft outboard drive unit to the watercraft. The main lower unit tilt brackets 116 and 117 attaches to female housing pivot section 104. The motor tilt pivot pin 115 goes through transom mounting bracket supports 113 and 114 and also through main lower unit tilt brackets 116 and 117. Motor mounting plate 128 supports motor and attaches to main lower unit housing retainer 130 that attaches to main lower unit housing 102. Motor mounting plate 128 is supported by motor mounting plate supports 132 and 133. Tiller handle 140 is mounted to motor mounting plate 128.

In more detail, still referring to the invention from FIG. 1 through FIG. 17 the horizontal drive shaft motor with flexible linkage to driven shaft outboard drive unit propels a watercraft by using a propeller 138 to make thrust and move the watercraft in 360 degrees because of design of flexible drive linkage through the pivoting point or steering axis where motor swivels on a horizontal plain to change direction of propulsion of watercraft. This is accomplished by a female housing pivot section 104 large enough to allow the main lower unit housing 102 to go through the center of the female housing pivot section 104 which allows the horizontal drive shaft motor with flexible linkage to driven shaft outboard drive unit to rotate 380 degrees. The main lower unit housing 102 needs to be large enough to accommodate the means for conveying rotational energy to go through the center of the pivoting point or steering axis from which watercraft is steered from a horizontal plain and move freely. The female housing pivot section 104 has to be larger than main lower unit housing 102 in order for it to allow the main lower unit housing 102 to fit through the middle of female housing pivot section and allowing it to rotate 360 degrees freely.

Figure 6:
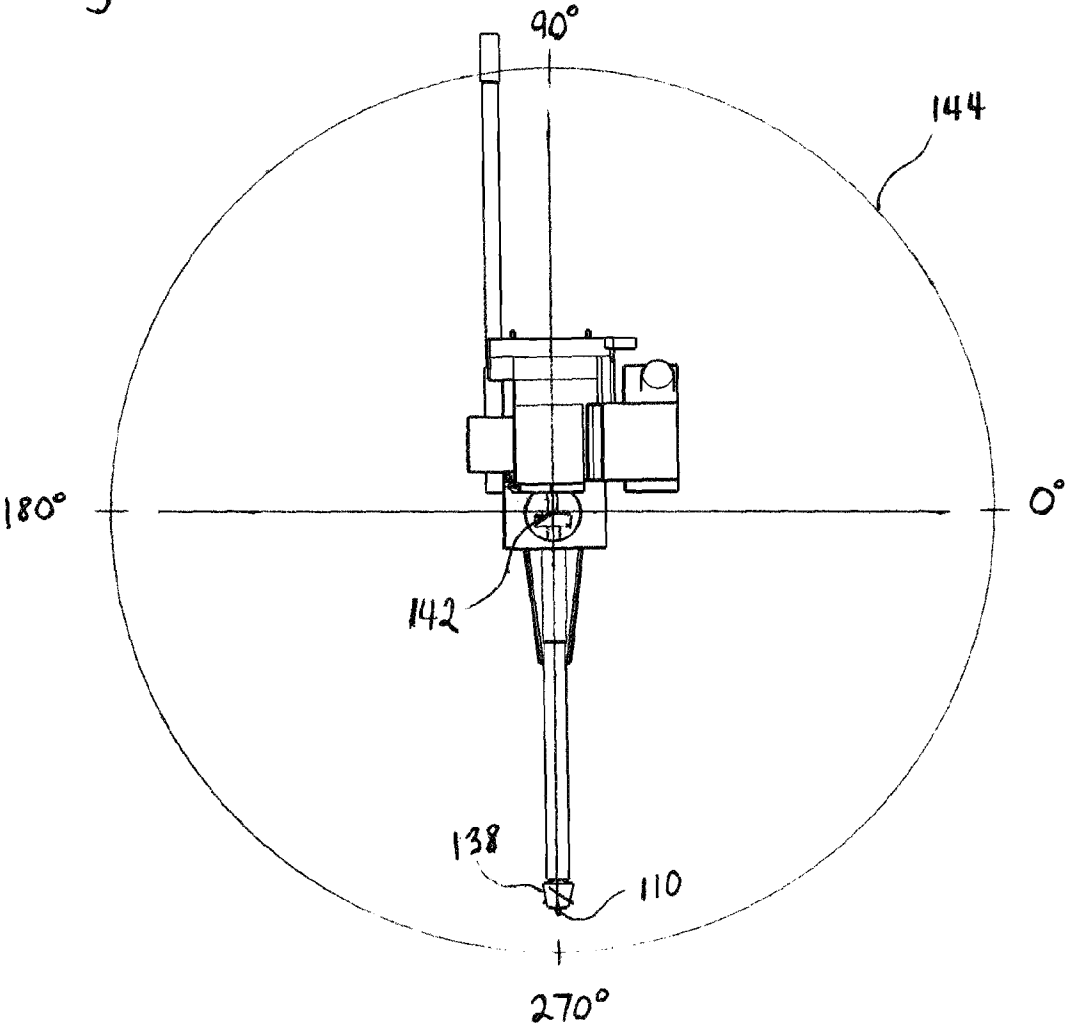
FIG. 6 illustrates a polar angle graph with horizontal drive shaft motor with flexible linkage to driven shaft outboard drive unit in center of said graph to explain steering axis and how horizontal drive shaft motor with flexible linkage to driven shaft outboard drive unit achieves 360 degrees of rotation all parts of said motor are pivotally rotational from center of said graph but not to include Transom mounting bracket, motor tilt brackets, female pivot section, and motor tilt pin that remain at polar angle 90 degrees, in this view the drive shaft and propeller are at polar angle 270 degrees.
Figure 7:
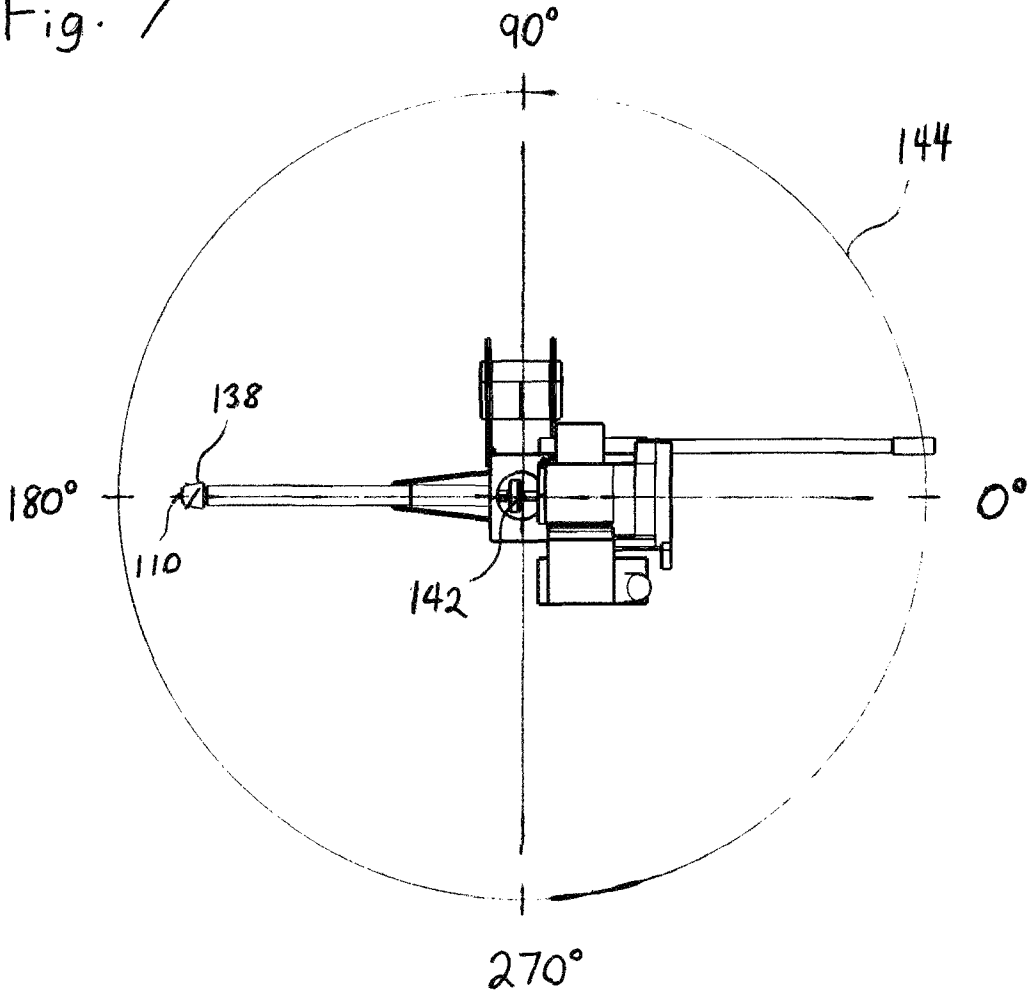
FIG. 7 illustrates a polar angle graph with horizontal drive shaft motor with flexible linkage to driven shaft outboard drive unit in center of said graph to explain steering axis and how horizontal drive shaft motor with flexible linkage to driven shaft outboard drive unit achieves 360 degrees of rotation all parts of said motor are pivotally rotational from center of said graph but not to include Transom mounting bracket, motor tilt brackets, female pivot section, and motor tilt pin that remain at polar angle 90 degrees, in this view the drive shaft and propeller are at polar angle 180 degrees.
Figure 8:
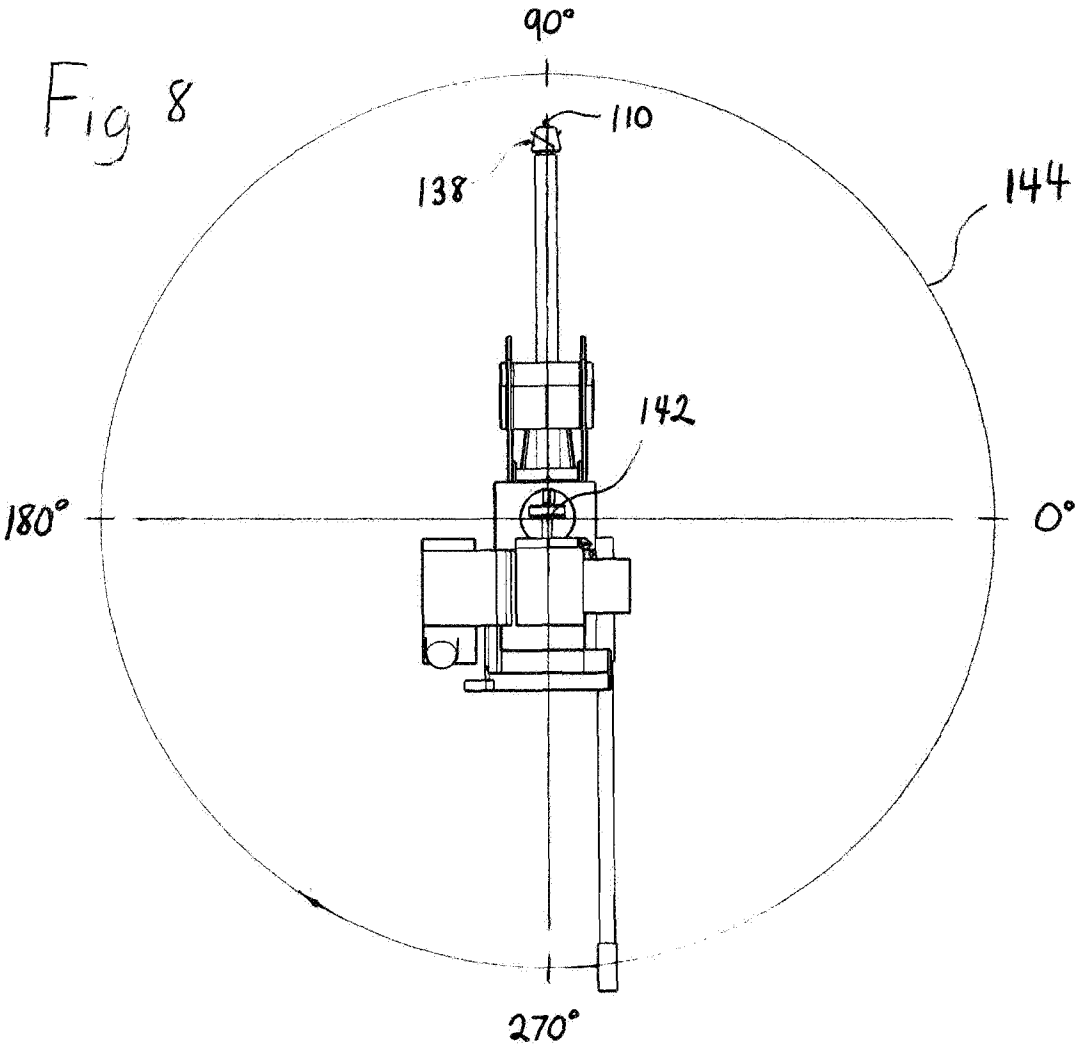
FIG. 8 is a different perspective sectional view of horizontal drive shaft motor with flexible linkage to driven shaft outboard drive unit to show inside of lower unit.
Figure 9:
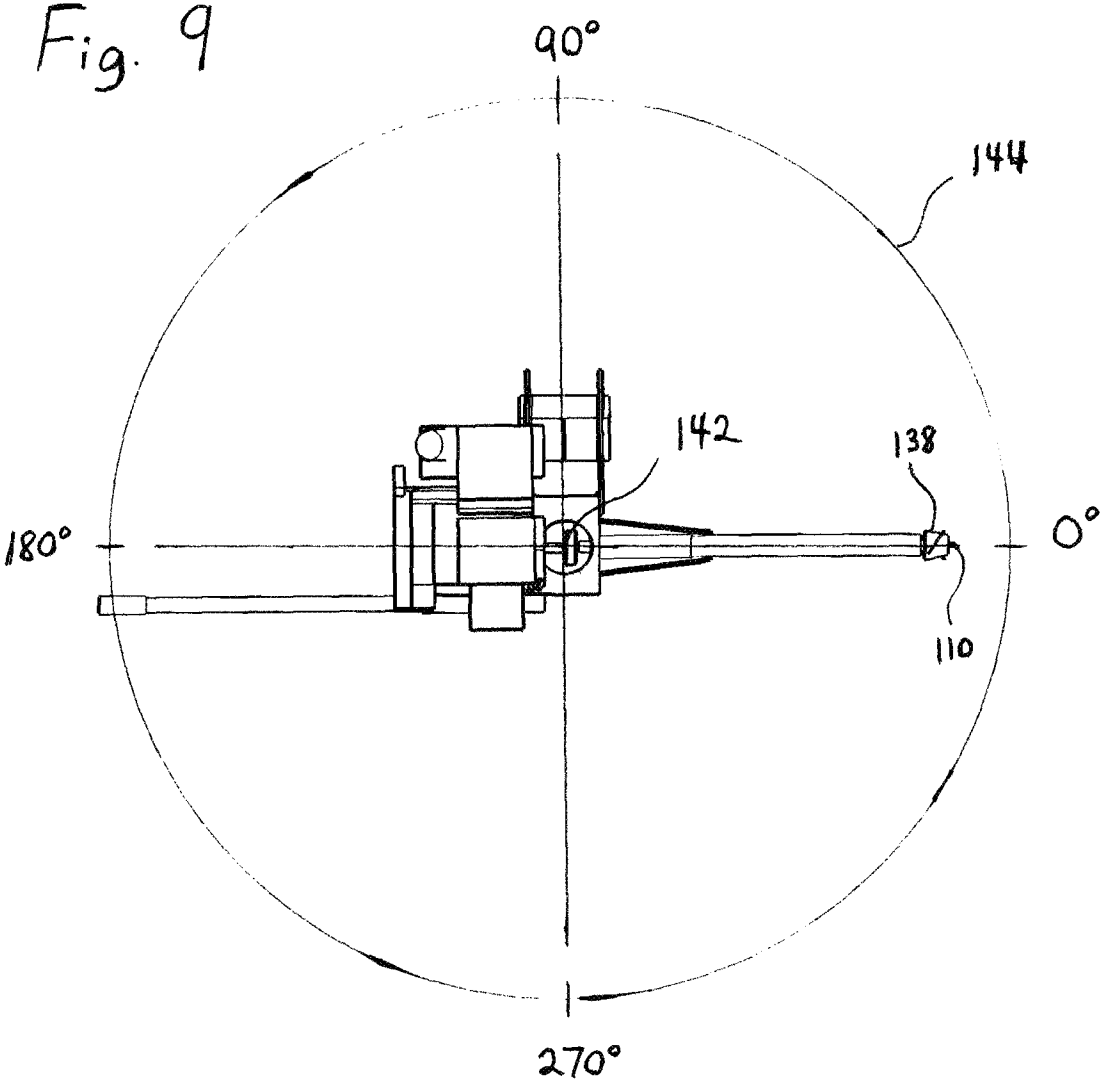
FIG. 9 illustrates a polar angle graph with horizontal drive shaft motor with flexible linkage to driven shaft outboard drive unit in center of said graph to explain steering axis and how horizontal drive shaft motor with flexible linkage to driven shaft outboard drive unit achieves 360 degrees of rotation all parts of said motor are pivotally rotational from center of said graph but not to include Transom mounting bracket, motor tilt brackets, female pivot section, and motor tilt pin that remain at polar angle 90 degrees, in this view the drive shaft and propeller are at polar angle 0 degrees.
Figure 10:
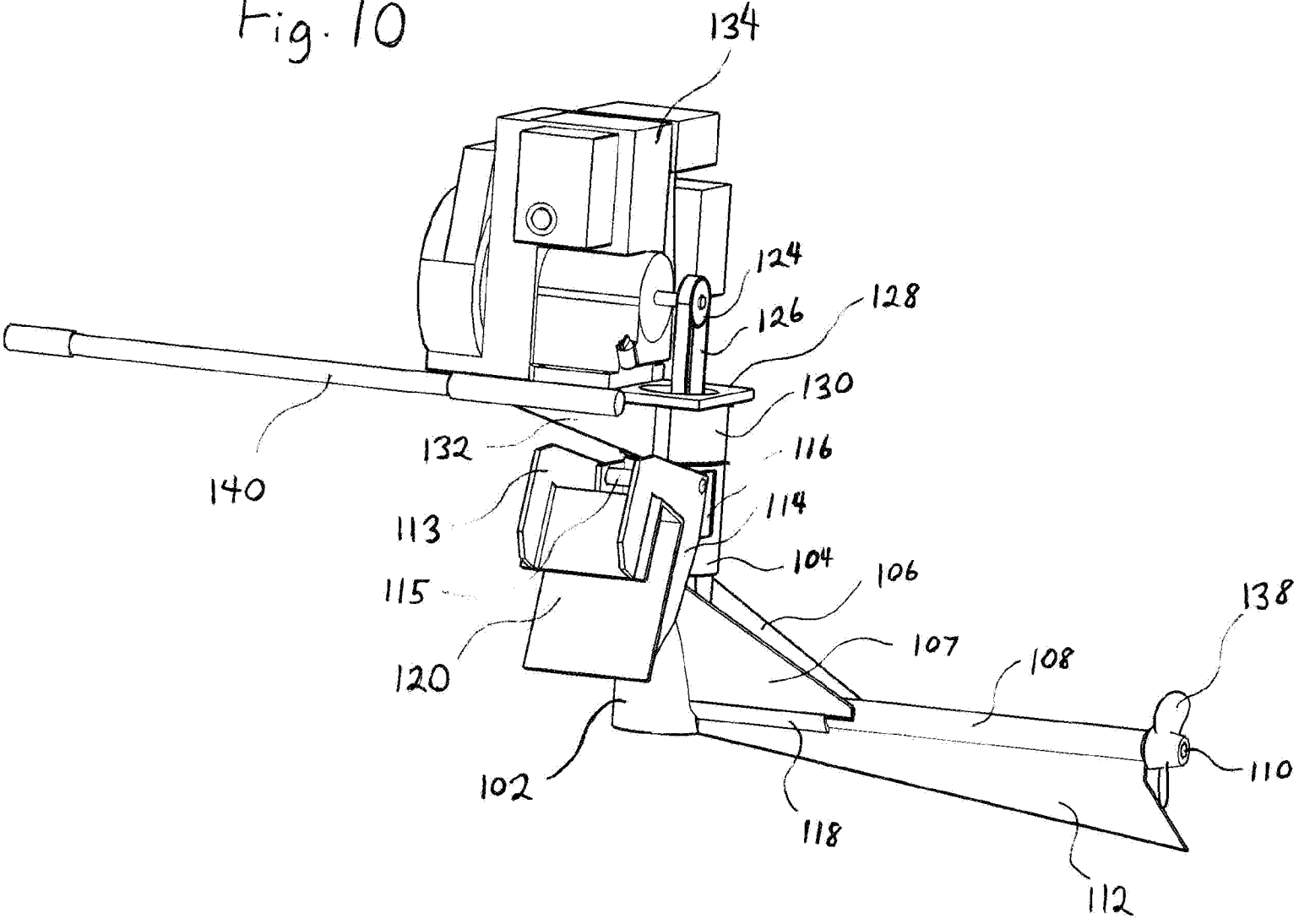
FIG. 10 is a perspective view of horizontal drive shaft motor with flexible linkage to driven shaft outboard drive unit to have a better understanding of FIG. 7 drawing.
Figure 11:
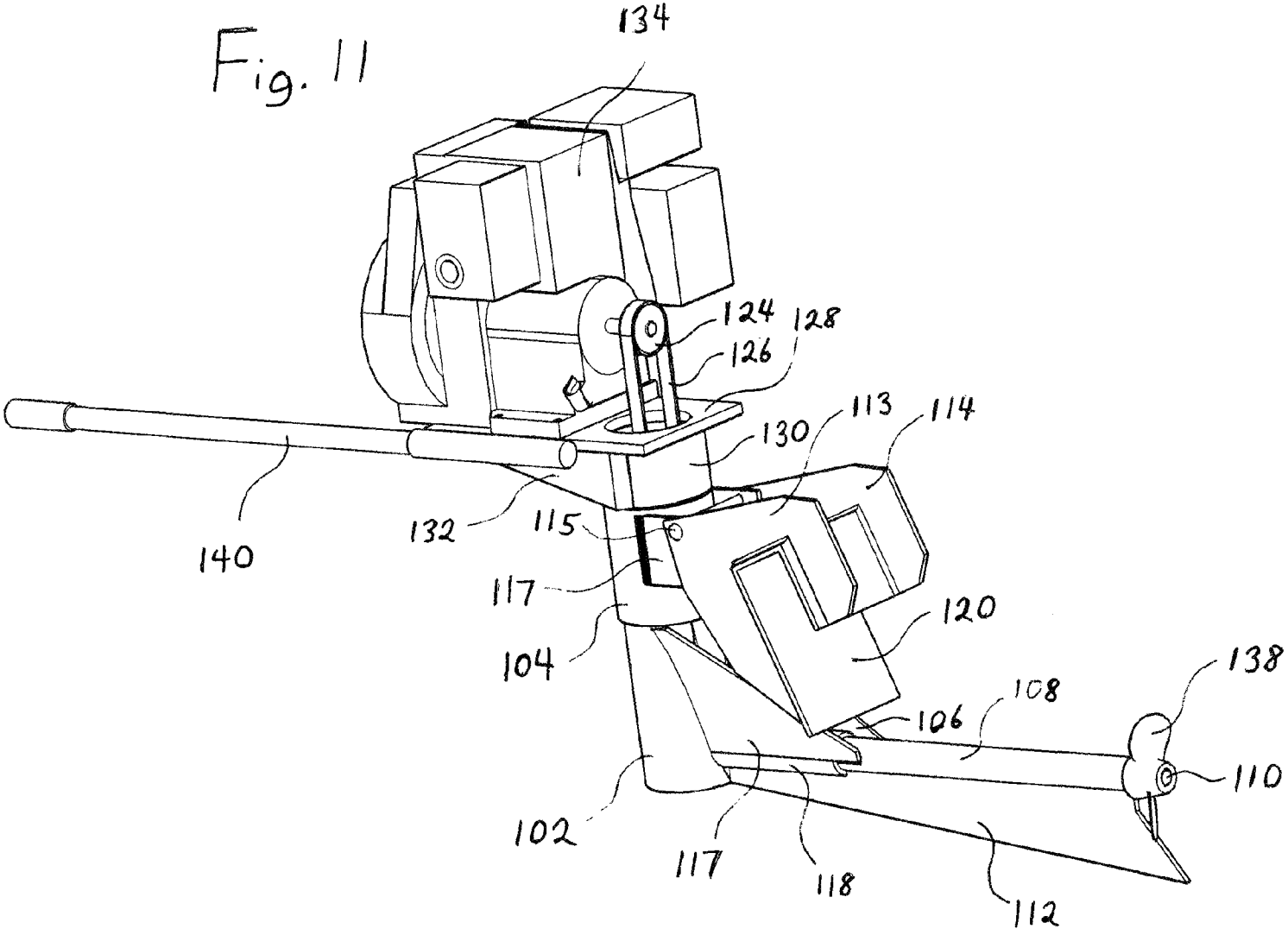
FIG. 11 is a perspective view of horizontal drive shaft motor with flexible linkage to driven shaft outboard drive unit to have a better understanding of FIG. 8 drawing.
Figure 12:
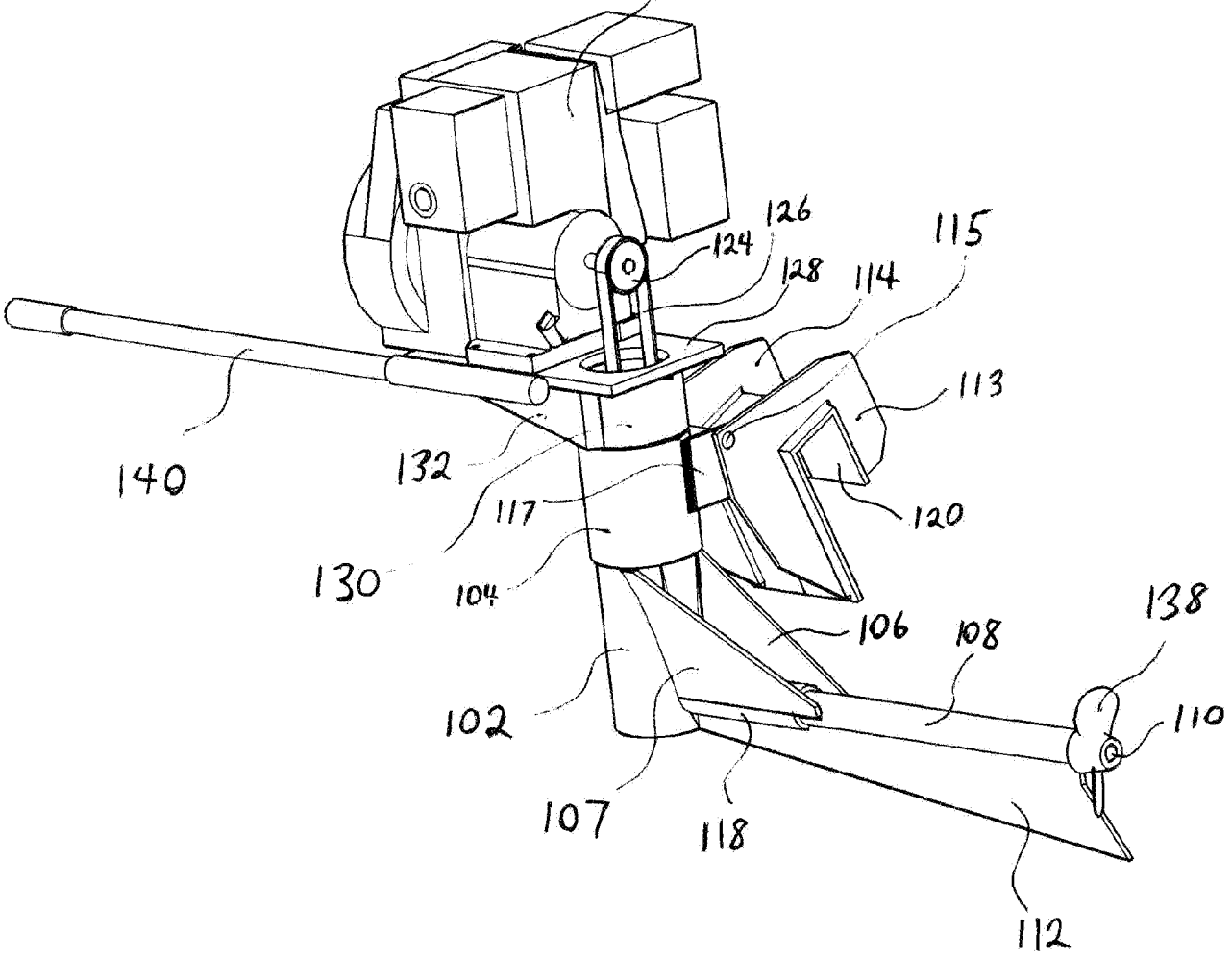
FIG. 12 is a perspective view of horizontal drive shaft motor with flexible linkage to driven shaft outboard drive unit to have a better understanding of FIG. 9 drawing.
Figure 13:
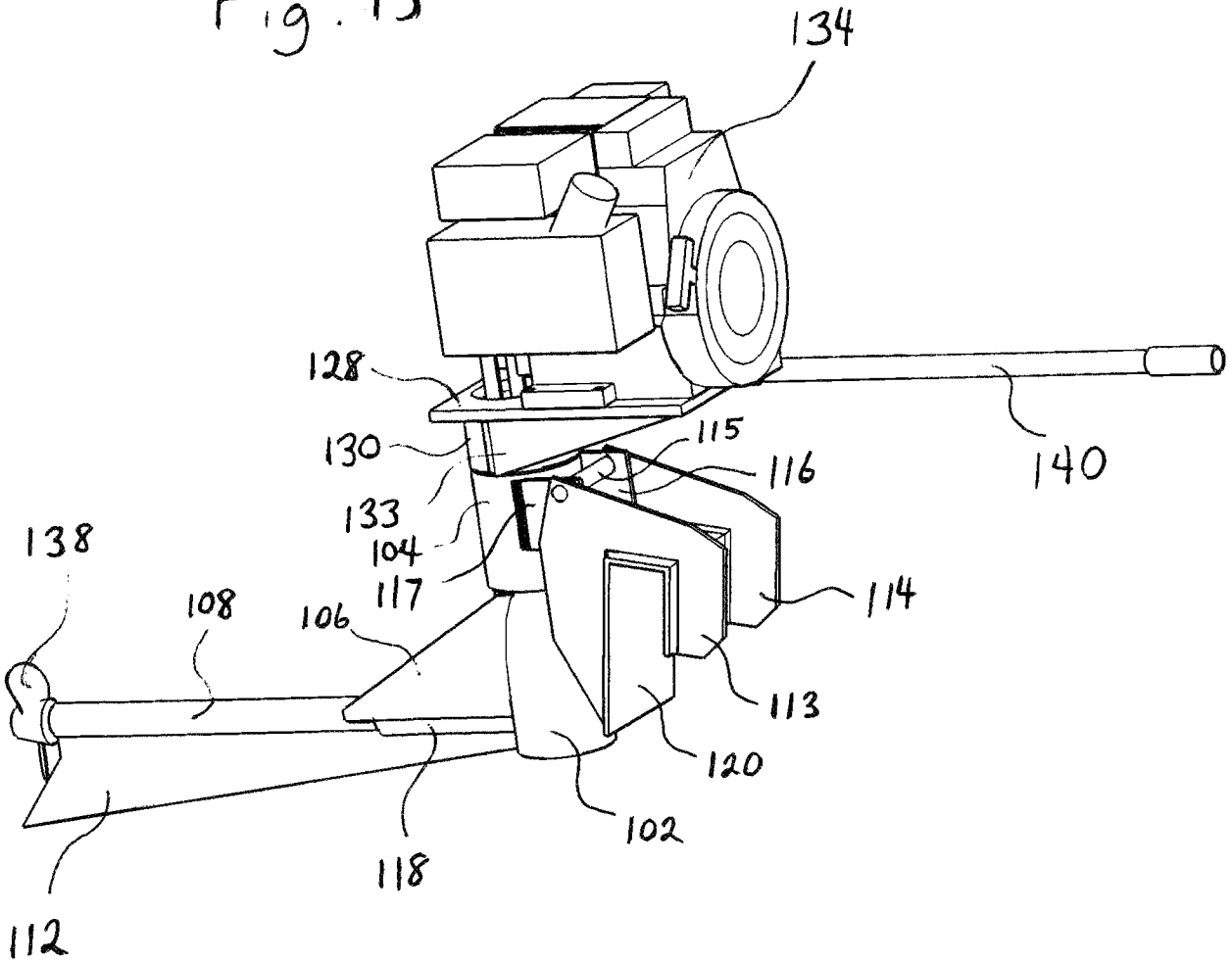
FIG. 13 is a perspective view of horizontal drive shaft motor with flexible linkage to driven shaft outboard drive unit to have a better understanding of FIG. 6 drawing.
Figure 14:
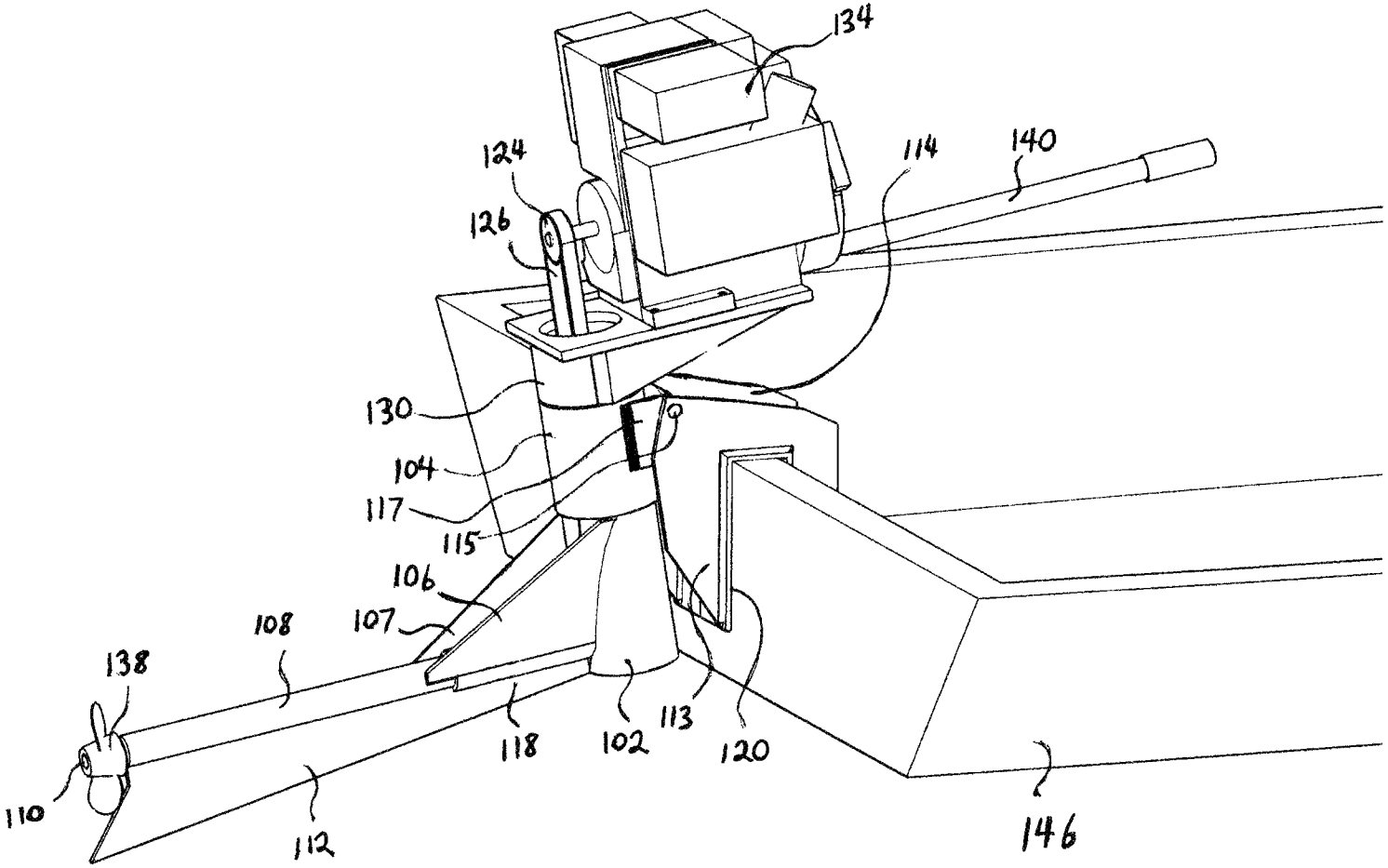
FIG. 14 is a perspective view of horizontal drive shaft motor with flexible linkage to driven shaft outboard drive unit mounted to a boat with said motor in same position as FIG. 6.
Figure 15:
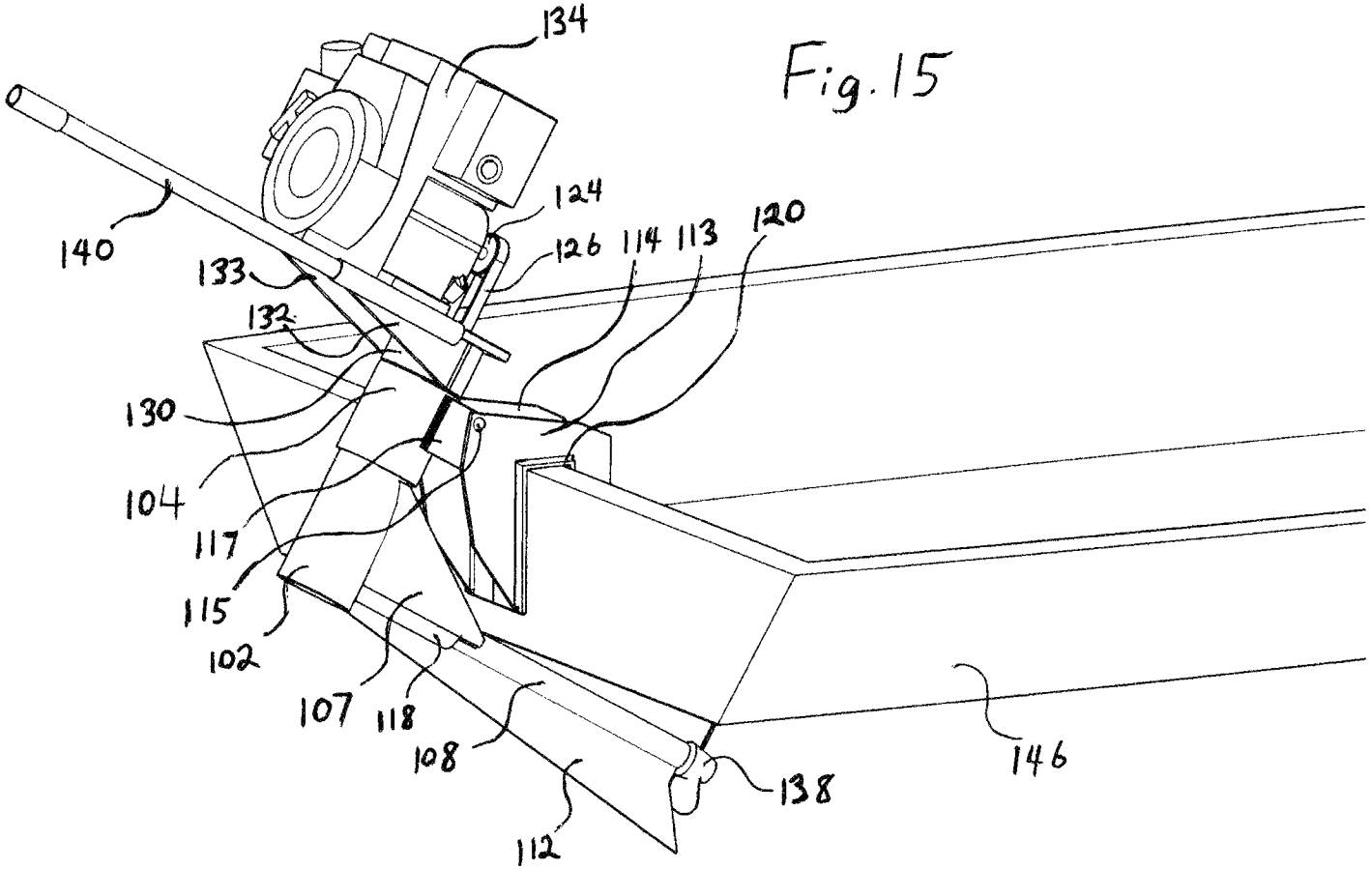
FIG. 15 is a perspective view of horizontal drive shaft motor with flexible linkage to driven shaft outboard drive unit mounted to a boat with said motor in same position as FIG. 8.
Figure 16:
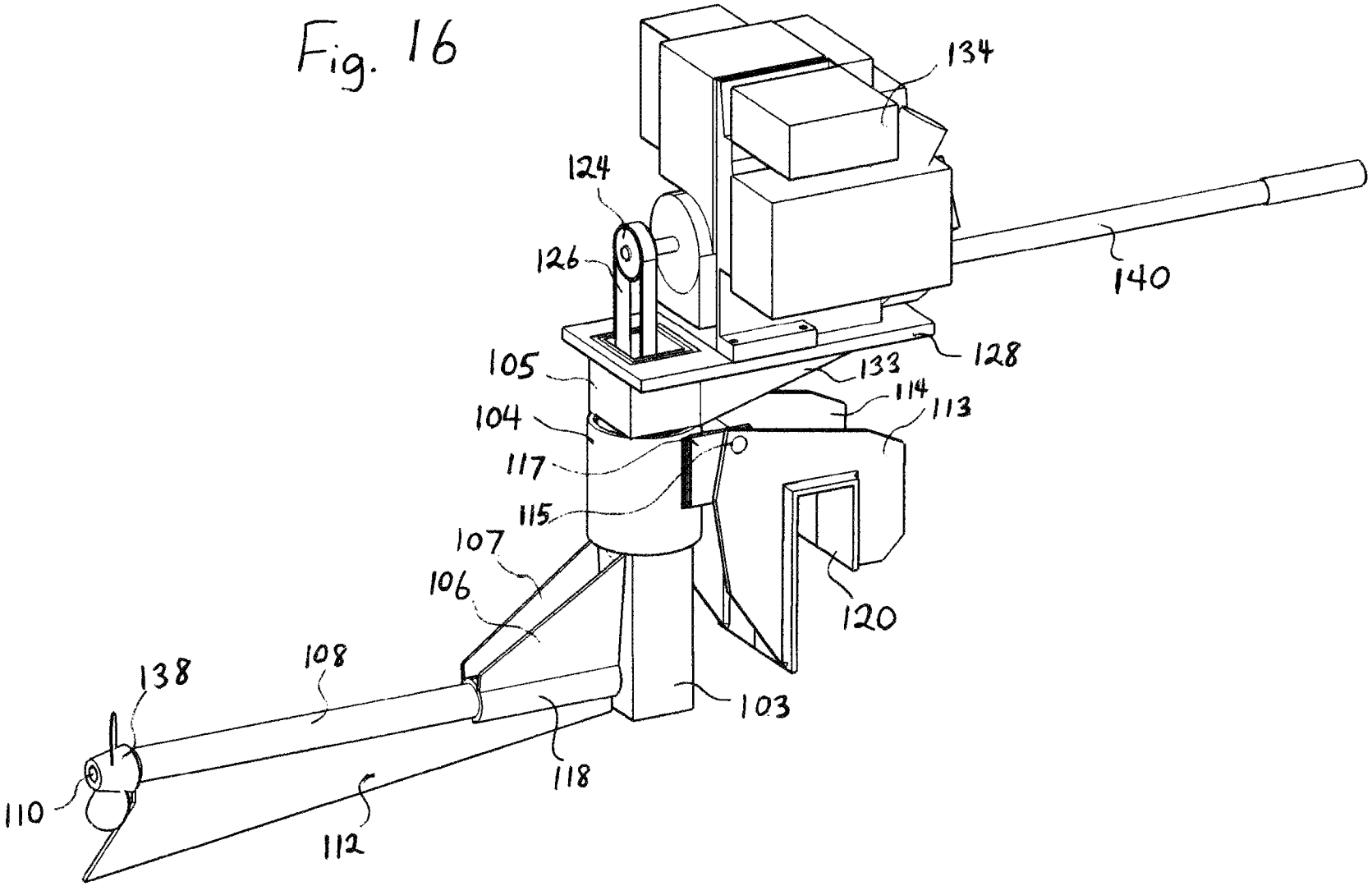
FIG. 16 is a perspective view of horizontal drive shaft motor with flexible linkage to driven shaft outboard drive unit showing a square main lower unit housing and square main lower unit housing retainer to show that said parts do not have to be cylindrical in shape and is not limited to one shape, and showing transom mounting bracket, female housing pivot section, main lower unit tilt brackets, and motor tilt pivot pin in same position as FIG. B.
Figure 17:
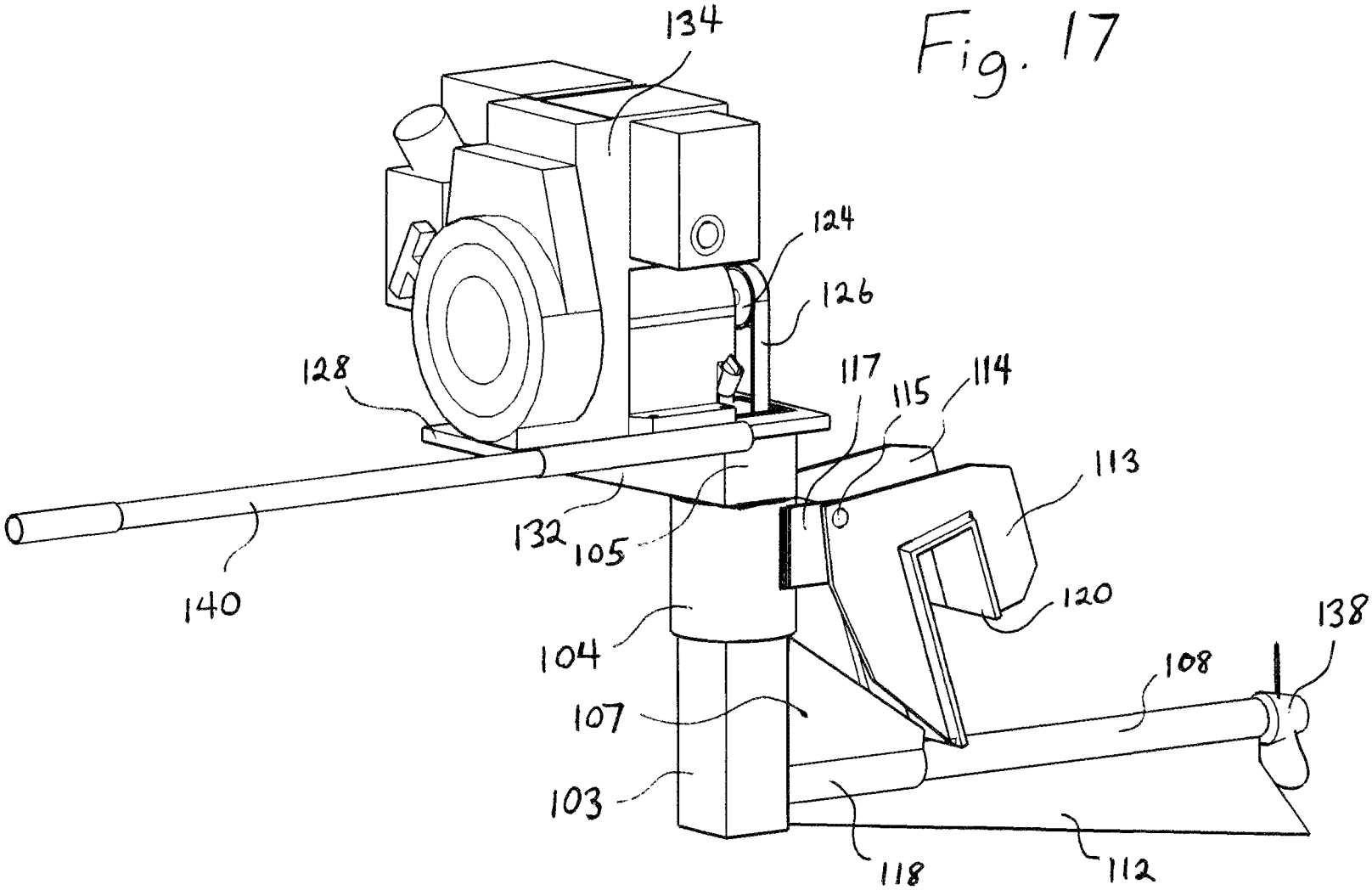
FIG. 17 is a perspective view of horizontal drive shaft motor with flexible linkage to driven shaft outboard drive unit showing a square main lower unit housing and square main lower unit housing retainer to show that said parts do not have to be cylindrical in shape and is not limited to one shape, and showing transom mounting bracket, female housing pivot section, main lower unit tilt brackets, and motor tilt pivot pin in same position as FIG. 8.

In further detail, still referring to the invention of FIG. 1 through FIG. 17, The main lower unit housing 102 has a approximate size of 3 to 10 Inches in outside diameter and does not have to be cylindrical in shape and can be almost any shape including but not limited to square, rectangular, triangular or other shapes as long as shape does not restrict means for conveying rotational energy from moving freely and has a wall thickness roughly ⅛ inch to 1 Inch thick depending on horse power of motor. The female housing pivot section 104 is always going to be larger in diameter than the main lower unit housing 102 with the approximate size of 3 to 10 inches in inside diameter with a wall thickness roughly ⅛ inch to 1 inch and does not need to be cylindrical in shape but must have a circular bearing or sleeve that circumscribes the shape going through the center of the female housing pivot section 104 and allows the main lower unit housing 102 to rotate inside of the female housing pivot section 104 freely 360 degrees. The lower unit shaft housing 108 is roughly 1½ inches in diameter and is roughly 20 inches in length. The lower unit bearing housing 118 is roughly 2 inches in outside diameter and roughly 8 inches in length. The skeg 112 is the length of the lower unit shaft housing 108 and the lower unit bearing housing 118 combined roughly 28 inches in length and tapers from where it starts by the propeller 138 from roughly 5 inches to where it ends next to the main lower unit housing 102 to roughly 1 inch. The lower unit supports 106 and 107 are shaped similar to a triangle. Illustrated in FIG. 6 from left to right it is roughly 12 inches in length and from top to bottom roughly 6 inches and tapers from roughly 6 Inches down to 1 inch from right to left. The drive shaft 110 is roughly ¾ of a Inch in diameter and is roughly 32 inches in length allowing it to enter into the main lower unit housing 102 roughly half the diameter of the main lower unit housing 102 allowing it to have the driven sprocket, pulley, Sheave, or other device 122 attached to it, and also stick out of lower unit drive shaft housing 108 roughly 3 inches where the propeller 138 attaches. Illustrated in FIG. 6 the main lower unit tilt bracket 117 is roughly 4 inches from top to bottom, and roughly 4 inches from left to right and roughly ¼ to ½ of a inch in thickness. The transom mounting bracket 120 has three sides, illustrated in FIG. 6 the left side being the longest roughly 10 inches and the top side roughly 3 inches and the right side roughly 4 inches and material thickness roughly ¼ of a inch in thickness, illustrated in FIG. 7 the transom mounting bracket 120 from top to bottom is roughly 5 to 12 inches depending on diameter of main lower unit housing 102. The transom mounting bracket supports 113 and 114 illustrated in FIG. 6 is roughly 3 inches in width around the outer profile of transom mounting bracket 120. Illustrated in FIG. 14 the drive sprocket, pulley, sheave, or other device 124 is roughly 3 Inches in diameter and the driven sprocket, pulley, sheave, or other device 122 is roughly 3 inches in diameter. The drive belt, chain, or other flexible linkage 126 is approximately 30 to 50 inches in circumference depending on set up and horse power of horizontal drive shaft motor and other factors to include the drive sprocket, pulley, sheave, or other device 124 and driven sprocket, pulley, sheave, or other device 122. The engine mounting plate 128 varies in size depending on size of bolt pattern on horizontal drive shaft engine 134 and is roughly same width of main lower unit housing 102 outside diameter. The main lower unit housing retainer 130 is the same size as the female housing pivot section 104 in inside and outside diameters and roughly 3 inches in length. Motor mounting plate supports 132 and 133 vary in size depending on horizontal drive shaft engine 134 size and motor mounting plate 128. Illustrated in FIG. 11 the motor mounting plate supports 132 from left to right taper up from 0 inches to roughly 3 Inches. The motor tilt pivot pin 115 goes through transom mounting bracket supports 113 and 114 and through the main lower unit tilt brackets116 and 117 and is roughly 1 Inch wider than width of the two main lower unit tilt brackets 116 and 117. The motor tilt pivot pin 115 is roughly ½ inch in diameter. The tiller handle 140 is approximately 1 inch in outside diameter and approximately 20 to 30 inches in length. FIG. 16 and FIG. 17 illustrate horizontal drive shaft motor with flexible linkage to driven shaft outboard drive unit with a square main lower unit housing 103 and a square main lower unit housing retainer 105 showing that said parts 103 and 105 do not have to be cylindrical in shape. FIG. 14 and FIG. 15 illustrate a small watercraft 146 to show horizontal drive shaft motor with flexible linkage to driven shaft outboard drive unit attached to a watercraft. FIG. 6 through FIG. 9 illustrate the horizontal drive shaft motor with flexible linkage to driven shaft outboard drive unit in a polar angle graph 144 and show the steering axis that horizontal drive shaft motor with flexible linkage to driven shaft outboard drive unit pivots on to steer boat or watercraft, and a understanding of how horizontal drive shaft motor with flexible linkage to driven shaft outboard drive unit rotates on steering axis 360 degrees.

The construction details of the invention as shown from FIG. 1 through FIG. 17 are that almost all the frame work of the horizontal drive shaft motor with flexible linkage to driven shaft outboard drive unit, to include parts 102, 103, 104, 105, 106, 107, 108, 112, 113, 114, 116, 117, 120, 128, 130, 132, 133, 140, are formed, cut, machined, welded, or any other metal working process needed, from but not limited to aluminum or steel but can be made from other forms of manufacturing and materials such as fiber glass, carbon fiber, high strength plastics or composites. The drive belt, chain, or other flexible linkage 126, is made from various materials depending on flexible linkage used and can be made from but not limited to rubber, steel, betted fibers or composites. The drive sprocket, pulley, sheave, or other device 124, and driven sprocket, pulley, sheave, or other device 122 can be made from various materials and can be made from but not limited to aluminum, steel, plastic, or other composite or alloy materials. The drive shaft 110 is made from but not limited to stainless steel or regular steel. The horizontal drive engine 134 is made from various materials from each manufacturer. The propeller 138 is made from but not limited to steel, stainless steel, aluminum, bronze, or other alloy materials. The motor tilt pivot pin 115 is made from but not limited to steal, stainless steel, aluminum, or other alloy materials.

The advantages of the present invention include, without limitation, a design using a less complicated design to achieve reverse. The horizontal drive shaft motor with flexible linkage to driven shaft outboard drive unit is simpler to manufacture because less parts are needed to achieve reverse. And also can be lighter due to less parts required to accomplish same task which is to have reverse. In addition, the reverse is much more efficient because the propeller never has to change the direction of rotation and is able to use the propellers maximum thrust which is an advantage over trying to get maximum thrust reverse by spinning propeller in opposite direction, due to the fact that a propeller is made to be most efficient in one direction clockwise or counter clockwise but not both. Another major advantage to this design over other designs with reverse is there are less parts and moving parts which makes this design more reliable and less likely for something mechanical to break or fall.

What is claimed is:

1. A surface drive outboard motor used for shallow water operation on a boat or watercraft, comprising:

a. a means to attach said surface drive outboard motor to said boat or watercraft b. a lower unit with an operational propeller for propelling a boat or watercraft that is pivotally attached to said means for attaching the surface drive outboard motor, the lower unit having a main lower unit housing and a lower unit shaft housing with the lower unit shaft housing section extending rearward from the main lower unit housing with a length typically used for surface drive outboard motors c. a propeller located at the rearward end of the lower unit shaft housing and driven via propeller shaft d. a horizontal drive shaft engine mounted to said lower unit for producing rotational energy to drive the propeller, an engine is mounted to the top of the main lower unit housing e. a belt, chain, to join the two parallel shafts for conveying rotational energy that connects said engine shaft to said propeller shaft that goes through hollow middle pivot point of said main lower unit housing f. and where said lower unit pivotally attaches is the steering axis for said surface drive outboard motor to pivot for steering said boat or watercraft whereby said lower unit and said means for conveying rotational energy and said engine can simultaneously rotate a full 360 degrees on steering axis.

* * * * *